United States Patent [19]

Roberts

[11] Patent Number: 4,492,333

[45] Date of Patent: Jan. 8, 1985

[54] SINGLE SLICE PIE CARTON WITH SLANTED OPENABLE REAR WALL AND BLANK FOR FORMING SAME

[75] Inventor: Harry H. Roberts, Roswell, Ga.

[73] Assignee: Champion International Corporation, Stamford, Conn.

[21] Appl. No.: 572,618

[22] Filed: Jan. 23, 1984

Related U.S. Application Data

[63] Continuation of Ser. No. 411,523, Aug. 25, 1982, abandoned.

[51] Int. Cl.[3] ..... B65D 5/00

[52] U.S. Cl. ..... 229/22; 206/551

[58] Field of Search ..... 229/22; 206/45.32, 551

[56] References Cited

U.S. PATENT DOCUMENTS

| | | | |
|---|---|---|---|
| 1,716,975 | 6/1929 | Phillips | 229/22 |
| 1,912,329 | 5/1933 | Wassell | 229/22 |
| 2,298,146 | 10/1942 | Meisbach | 229/22 |
| 2,583,915 | 1/1952 | Whitley | 229/22 |
| 2,701,090 | 2/1955 | Buttery | 229/22 |
| 3,142,430 | 7/1964 | Meyers | 229/22 |
| 4,313,542 | 2/1982 | Roberts | 229/22 |
| 4,432,490 | 2/1984 | Roberts | 229/22 |

FOREIGN PATENT DOCUMENTS

| | | | |
|---|---|---|---|
| 328495 | 8/1935 | Italy | 229/22 |
| 406054 | 1/1966 | Switzerland | 229/33 |
| 427845 | 5/1935 | United Kingdom | 229/22 |
| 530148 | 12/1940 | United Kingdom | 229/22 |

*Primary Examiner*—William Price
*Assistant Examiner*—Gary E. Elkins
*Attorney, Agent, or Firm*—Evelyn M. Sommer; John H. Mulholland; William W. Jones

[57] ABSTRACT

A carton and blank for forming a carton are provided for a single serving of dessert pie. The carton formed from the blank is substantially wedge shaped and includes top and bottom panels disposed in parallel relationship. The top and bottom panels define similar isosceles triangles, but the top panel is larger than the bottom panel thereby reflecting the actual configuration of the pie packaged therein. The subject carton formed from the blank includes a plurality of rear opening flaps providing access to the container from the rear. Additionally, the carton, has a double side wall and a double slanted rear wall to protect the fragile slice of pie.

9 Claims, 4 Drawing Figures

SINGLE SLICE PIE CARTON WITH SLANTED OPENABLE REAR WALL AND BLANK FOR FORMING SAME

This application is a continuation of application Ser. No. 06/411,523, filed 8/25/82, now abandoned.

BACKGROUND OF THE INVENTION

Dessert pies typically have been baked, packaged and sold in frusto-conical pie plates having a side wall extending upwardly and outwardly from a round flat bottom. However, recently a substantial market has developed for dessert pies that are packaged and sold in single serving size wedge shaped slices. Each slice of dessert pie is packaged in a wedge shaped container having substantially the same configuration as the slice of pie packaged therein. Slices of pie packaged in this manner can be purchased by the consumer in any convenient quantity. Thus, the consumer purchases only as many slices of pie as are needed, thereby ensuring that there will be no excess to become stale or spoiled. As an alternative, the individual servings of dessert pies can be frozen either by the baker or by the consumer. The consumer then can purchase a larger number of servings of the dessert pie, which can be thawed out and consumed whenever convenient.

Several wedge shaped containers have been developed for the shipping and storage of individual slices of pie. Paper board containers adapted for this purpose include U.S. Pat. No. 2,220,110 issued to Layton; U.S. Pat. No. 2,701,091 issued to Buttery; U.S. Pat. No. 3,623,650 issued to Watts and U.S. Pat. No. 3,876,131 issued to Tolaas. Wedge shaped plastic containers adapted for the same purposes include U.S. Pat. No. 3,620,403 and U.S. Pat. No. 3,620,411 both of which issued to Rump.

The prior art containers described in the above cited references have been deficient in certain respects. Specifically, each of these prior art containers includes three side walls that are substantially perpendicular to the bottom surface of the container. The slices of pie stored in these prior art containers, however, include a rear edge that slants upwardly and outwardly away from the bottom surface of the pie. Thus, the containers referred to above do not closely conform to the configuration of the slices of pie stored in these prior art containers. As a result, the prior art containers cited above provide poor protection and support for fragile slices of pie.

A second deficiency of the above cited prior art containers is that all include top opening members which require the fragile slices of pie to be loaded and unloaded from the top of the container. This top opening feature has made it difficult for bakers to place the pie into the package and for consumers to remove the pie from the package. More particularly, bakers have found that automatic loading devices cannot reliably place the delicate servings of pie into the packages having top opening members. Attempts to minimize the possibility of damage to the slices of pie during packaging have resulted in low packaging rates. Larger containers facilitate insertion and removal of the pie somewhat, but provide poor support during shipping and storage. Similarly, to remove the slice of pie from one of these prior art containers, the consumer typically will grasp the rear crust of the pie and lift the rear of the pie up. This creates a bending moment on the delicate bottom crust, and thereby makes damage likely.

U.S. Pat. No. 2,583,915 issued to Whitley and U.S. Pat. No. 2,584,379 issued to Chmielewski both are directed to containers for individual wedge shaped slices of pie that conform more closely to the actual configuration of the pie. Specifically, both of these containers include a pair of trapezoidal side walls and a rear wall that slants upwardly and outwardly away from the bottom of the container. The Whitley reference, however, provides a rear wall that offers little support to the structure, and also requires top loading and unloading. The Chimiliski structure provides no top wall and therefore would offer even less structural support for the pie.

U.S. Pat. No. 3,142,430 issued to Meyers is directed to a wedge shaped container with a side opening panel. However, the Meyers container appears to be designed for one or more triangular sandwiches that typically would be formed by slicing a square sandwich along a diagonal. Consequently, all three side walls of the Meyers container are substantially perpendicular to the top and bottom walls. Thus, although the Meyers container avoids top loading, the three upstanding side walls of the Meyers container would provide poor structural support for a fragile slice of pie.

U.S. Pat. No. 4,313,542 which issued to Henry H. Roberts and Raymond A. Cote on Feb. 2, 1982, and which is assigned to the assignee of the subject invention is directed to a single serving pie carton and blank which provides very good structural support for a slice of pie. Specifically, the Roberts et al carton of U.S. Pat. No. 4,313,542 includes a pair of side walls and a rear wall extending between and connecting parallel top and bottom walls. The top wall of the carton of U.S. Pat. No. 4,313,542 is of a larger area than the bottom wall, and the side walls each are trapezoidal. As a result, the rear wall on the erected carton of U.S. Pat. No. 4,313,542 is slanted with respect to the top and bottom walls. Thus, the carton of U.S. Pat. No. 4,313,542 closely conforms to the configuration of the slice of pie stored therein. Additionally, the side and rear walls of the carton of U.S. Pat. No. 4,313,542 provide adequate protection and support for the slice of pie stored in the carton.

Despite the many advantages of the carton of U.S. Pat. No. 4,313,542, it is desired to provide an improved wedge shaped carton that provides the desirable structural support of the carton of U.S. Pat. No. 4,313,542, but that also can be loaded from the rear.

In view of the above, it is an object of the subject invention to provide an improved container and a blank for forming a container for a single slice of pie that enables easy loading and removal of the pie from the rear of the container.

It is another object of the subject invention to provide a container and a blank for forming a container for a single slice of pie that enables loading of the pie into the container at an acceptable rate by known packaging devices.

It is a further object of the subject invention to provide a container and a blank for forming a container for a single slice of pie that has a double side wall and a double slanted rear wall to provide the necessary support for the fragile pie during shipping and storage.

It is an additional object of the subject invention to provide a container for a single slice of pie that can be manufactured easily and inexpensively from a unitary paperboard blank.

SUMMARY OF THE INVENTION

The subject invention provides a rear opening wedge shaped carton for a single slice of pie. The wedge shaped carton includes top and bottom panels, which define a pair of similar isosceles triangles disposed in spaced parallel relationship to one another. The top and bottom panels each include a base edge and a pair of equal side edges which converge toward one another and meet at an apex. Preferably, the top and bottom panels are disposed with respect to one another such that a line extending through the respective apexes would be perpendicular to both the top and bottom panels. Although the angles defining the top and bottom panels are equal, the side and base edges of the top panel are longer respectively than the side and base edges of the bottom panel.

A pair of substantially identical trapezoidal side walls are hingedly attached to and extend between the top and bottom panel side edges. Each trapezoidal side wall is substantially perpendicular to both the top and bottom panels. As explained further below, one trapezoidal side wall is defined by substantially identical inner and outer side wall panels that are adhesively secured into face to face contacting relationship. More particularly, the inner panel is foldably connected to the bottom panel and extends upwardly therefrom, the outer panel is foldably connected to the top panel and extends downwardly therefrom. This double side wall contributes to the strength of the subject container thereby affording adequate protection to the slices of pie stored therein.

The opening members of the subject container include a pair of tabs that are foldably connected respectively to the side walls of the container, and a pair of substantially identical isosceles trapezoidal flaps that are foldably connected respectively to the base edges of the top and bottom panels. More particularly, the base edge of the top panel defines the longer parallel edge of the top flap, and the base edge of the bottom panel defines the shorter parallel edge of the bottom flap. The double rear wall not only enables easy rear loading and unloading of the pie from the subject container, but also contributes to the strength of the container thereby providing the necessary support for the fragile slices of pie stored in the container.

The wedge shaped container described above conforms closely to the size and configuration of the slice of pie stored therein. Specifically, the top wall of the container is larger than the bottom wall to reflect the fact that the top surface of the slice of pie is larger than the bottom surface. Additionally, the rear wall of the container as defined by the rear tabs and the top and bottom flaps is disposed at an angle to the top and bottom panels that corresponds to the angle of the crust of pie between the rear and bottom surfaces of the pie. Thus, the subject container will allow for very little movement of the pie within the container during shipping and storage and will ensure that the pie is uniformly supported on all sides.

The blank for forming the subject container includes a trapezoidal first side panel defined by a pair of parallel but unequal edges and a pair of non-parallel and unequal edges which extend between the parallel edges. The shorter of the top non-parallel edges is perpendicular to the two parallel edges, and will define the front edge of the carton erected from the subject blank.

An isosceles triangular top panel having a pair of equal side edges and a base edge is hingedly connected to the first side panel such that the longer of the two parallel side edges of the first side panel defines a side edge of the isosceles triangular top panel. Similarly, an isosceles triangular bottom panel having a pair of equal side edges and a base edge is hingedly connected to the first side panel such that the shorter of the two parallel edges of the first side panel defines a side edge of the isosceles triangular bottom panel.

A second side panel is foldably connected to the remaining side edge of the top panel. Similarly, a third side panel is foldably connected to the remaining side edge of the bottom panel. The second and third side panels each defines a trapezoid having a size and configuration substantially identical to the first side panel. The second and third side panels are folded into face to face contact to define a side wall of the container. To ensure that the second and third side panels will be in proper register on the erected carton, the second side panel has its longer parallel edge defining the hinged connection to the top panel, whereas the third side panel has its shorter parallel edge defining the hinged connection to the bottom panel.

A front tab is hingedly connected to the shorter of the two non-parallel edges of the first side panel. The fold line between the front tab and the first side panel will define the front edge of the carton erected from the subject blank. On the carton erected from the subject blank, the front tab will be adhesively connected to the third side panel thereby ensuring that the front edge of the subject carton is securely closed.

The subject blank further includes a pair of substantially identical isosceles trapezoidal flaps that are hingedly connected to the base edges of the top and bottom panels respectively. More particularly, the base edge of the top panel defines the longer of the two parallel edges of the trapezoidal flap connected to the top panel. Conversely, the base edge of the bottom panel defines the shorter of the two parallel edges of the trapezoidal flap connected to the bottom panel. A first tab is foldably connected to the longer of the two non-parallel edges of the first side panel, and a second tab is foldably connected to the longer of the two non-parallel edges of the third side panel. The first and second tabs and the pair of isosceles trapezoidal flaps define the rear opening members of the carton erected from the subject blank. The first and second tabs may assume any configuration which assures that the first and second tabs can be properly folded into the erected carton. In an alternate embodiment, however, the first and second tabs assume a locking tab configuration and cooperate with slits provided in one or both trapezoidal flaps.

DETAILED DESCRIPTION OF THE PREFERRED EMBODIMENTS

Figure 1:
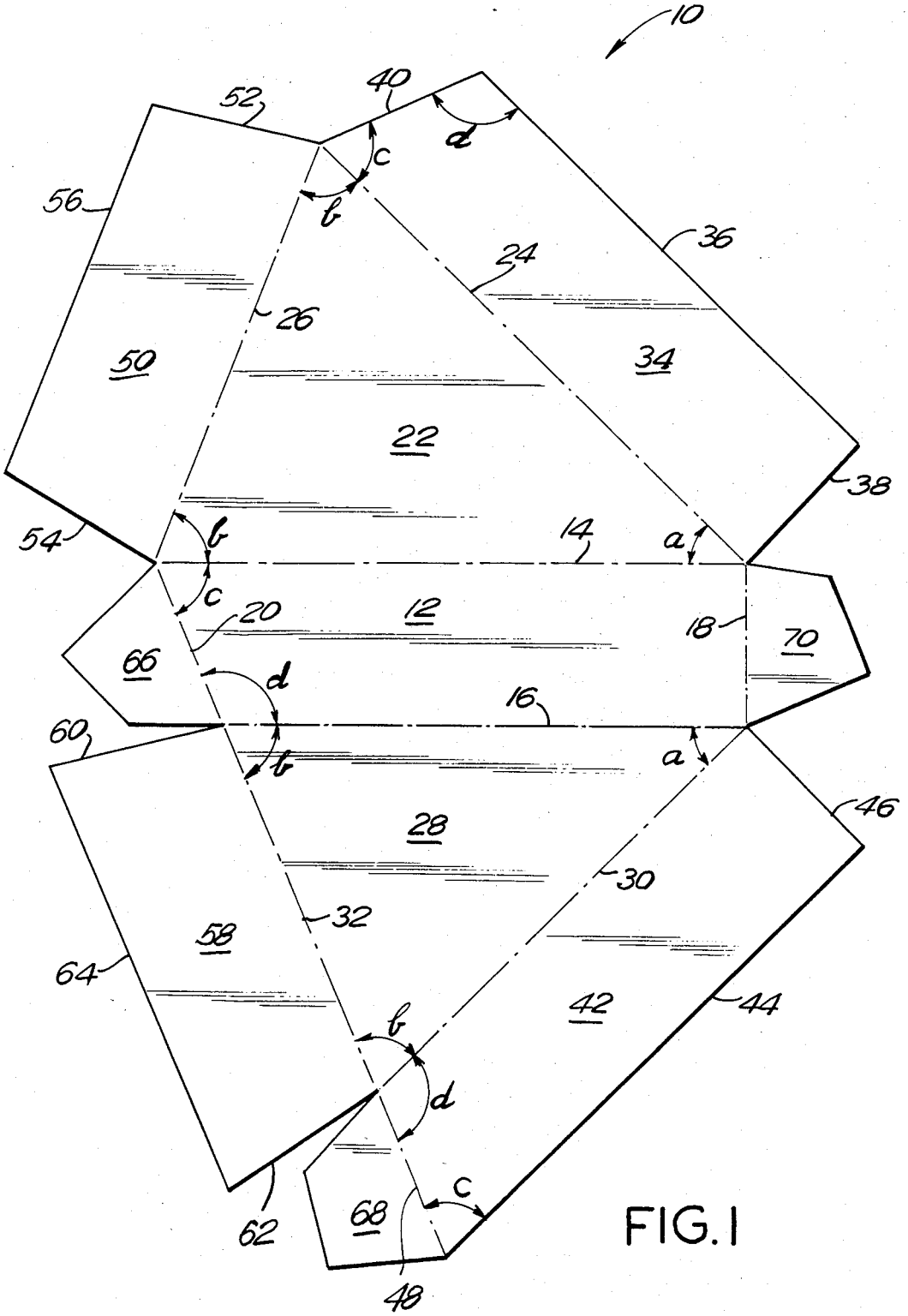
FIG. 1 is the preferred embodiment of the blank of the subject invention.

The rear opening pie container of the subject invention is erected from a paperboard blank 10 as shown in FIG. 1. Blank 10 includes a trapezoidal first side panel 12 which is defined by a pair of parallel edges 14 and 16 and a pair of non-parallel edges 18 and 20. Edge 18 of first side panel 12 is the shorter of the two non parallel edges, and is perpendicular to the parallel edges 14 and 16 of first side panel 12. Edge 14 is the longer of the two parallel edges of side panel 12, and will define a top side edge of a carton erected from the subject blank.

An isosceles triangular top panel 22 is foldably connected to the first side panel 12 along the longer parallel edge 14 thereof. The top panel 22 is further defined by edge 24, which is equal in length to edge 14, and by base edge 26 which defines the base of the isosceles triangular top panel 22. Edge 24 extends from the intersection of edges 14 and 18 of first side panel 12, such that the intersection of edges 14 and 24 defines the apex of the isosceles triangular top panel 22 from which the equal edges 14 and 24 extend. Top panel 22 will define the top of the container erected from the subject blank 10. Therefore, top panel 22 will substantially conform in size and configuration to the top surface of the slice of pie packaged in the subject container.

Bottom panel 28 is foldably connected to the first side panel 12 along the shorter parallel edge 16 thereof. The bottom panel 28 also is an isosceles triangle, and is further defined by edge 30 which is equal to edge 16. Base edge 32 of bottom panel 28 extends between the non-intersecting ends of the equal edges 16 and 30, and thus defines the base of the isosceles triangular bottom panel 28.

The angle "a" formed by the intersection of the equal edges 14 and 24 of top panel 20 substantially equals the angle "a" formed by the intersection of the equal edges 16 and 30 of the bottom panel 28. It follows that the angles "b" formed by the intersection of the base edge 26 with the equal edges 24 and 14 of top panel 22 will substantially equal the angles "b" formed by the intersection of base edge 32 with equal edges 16 and 30 of bottom panel 28. Thus, top and bottom panels 22 and 28 define similar isosceles triangles. However, top panel 22 is larger than bottom panel 28.

The magnitude of angle "a" will vary according to the relative size of the slice of pie to be packaged in the carton to be erected from blank 10. Since the pie will almost always be cut into four or more pieces, the angle "a" will almost always be less than or equal to 90°. If the pie is cut into six equal slices, the angle "a" will equal 60°, and the top and bottom panels 22 and 28 will define equilateral isosceles triangles.

A second side panel 34 is foldably connected to top panel 22 along edge 24 thereof. Second side panel 34 is identical in size and configuration to first side panel 12. Thus, second side panel 34 includes edge 36 which is parallel to edge 24 and equal in length to edge 16 of first side panel 12. The non-parallel sides of trapezoidal side panel 34 are defined by edges 38 and 40, which correspond in length to edges 18 and 20 respectively of first side panel 12. Additionally, edge 38 of second side panel 34 is substantially perpendicular to both edges 24 and 36 thereof.

A third trapezoidal side panel 42 is foldably connected to bottom panel 28 along edge 30, and is identical in size and configuration to the first and second side panels 12 and 34. The trapezoidal third side panel 42 is further defined by edge 44 which is parallel to edge 30 and by edges 46 and 48. Edge 30 is substantially equal in length to edges 16 and 36 of the first and second side panels 12 and 34. Edge 44 of third side panel 42 is longer than edge 30, and is substantially equal in length to edges 14 and 24 of the first and second side panels 12 and 34. Edges 46 and 48 of third side panel 42 are substantially equal in length to the corresponding edges of the first and second side panels 12 and 34. Also, edge 46 extends from the intersection of edges 16 and 30 substantially perpendicular to edge 30.

Because of the equivalent shapes of first, second and third side panels 12, 34 and 42, the angles "c" shown in FIG. 1 will all be equal. Similarly, the angles "d" will all be equal. The relative magnitudes of angles "c" and "d" will vary according to the relative differences in size between top and bottom panels 22 and 28. The sizes of top and bottom panels 22 and 28, in turn, depends upon the configuration of the slice of pie packaged within the container erected from the blank 10. However, the angle "c" will always be less than 90°, and the angle "d" will always be greater than 90°.

An isosceles trapezoidal top rear flap 50 is foldably connected to top panel 22 along base edge 26 thereof. Base edge 26 is the longer of the two parallel side edges of isosceles trapezoidal top rear flap 50. Edges 52 and 54 converge towards one another from the opposed ends of edge 26. The remaining side of the trapezoidal top rear flap 50 is defined by edge 56 which is parallel to but shorter than edge 26. On the erected carton, as explained further below, top rear flap 50 will be rotated about edge 26 during the opening or closing of the container erected from blank 10.

The bottom rear flap 58 is substantially identical in size and configuration to top rear flap 50, and is foldably connected to the bottom panel 28 along base edge 32 thereof. Edges 60 and 62 of bottom rear flap 58 diverge away from each other as they extend from edge 32. The bottom rear flap 58 is further defined by edge 64 which is parallel to but longer than edge 32. Edge 64 of bottom rear flap 58 is substantially equal in length to edge 26 of top rear flap 50. Similarly, edge 32 of bottom rear flap 58 is substantially equal in length to edge 56 of top rear flap 50. Bottom rear flap 58 can be rotated about edge 32 during the opening and closing of the container erected from the blank 10 shown in FIG. 1.

Rear tabs 66 and 68 also will define a portion of the opening members of the carton erected from the blank in FIG. 1. Specifically, rear tab 66 is foldably connected to the first side panel 12 along edge 20 thereof. Similarly, rear tab 68 is foldably connected to the third side panel 42 along edge 48 thereof. Front tab 70 is foldably connected to edge 18 of first side panel 12, and as explained further herein, front tab 70 functions to securely close the front portion of the container erected from blank 10.

Figure 2:
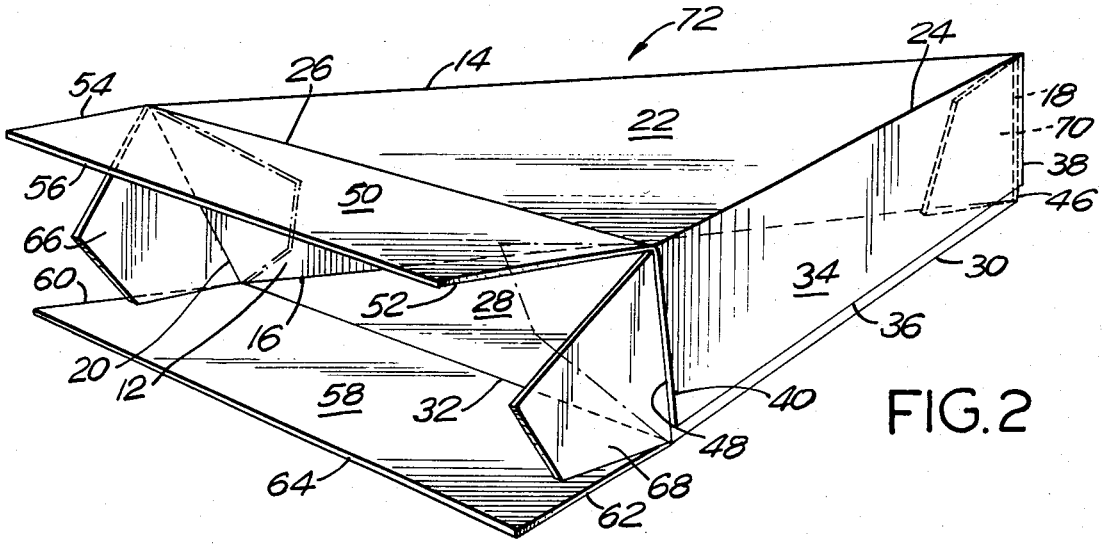
FIG. 2 is a perspective view of the partially erected container formed from the blank of FIG. 1.

To erect the subject container from the blank 10 shown in FIG. 1, the top and bottom panels 22 and 28 are rotated toward one another about edges 14 and 16 until top and bottom panels 22 and 28 are substantially parallel to one another and perpendicular to the first side panel 12. The first side panel 12 thus defines one of the two identical side walls of the carton erected from blank 10. The second side wall of the subject carton is formed by rotating front tab 70 about edge 18 of first side panel 12 until the angle separating front tab 70 from the first side panel 12 is approximately equal to angle "a". The remainder of the second side wall of the container erected from blank 10 is formed by first rotating the third side panel 42 about edge 30 until it is perpendicular to bottom panel 28, and then rotating the second side panel 34 about edge 24 until it is perpendicular to the top panel 22. In this position, the second and third side panels will be in face to face abutting relationship and the front tab 70 will be in face to face contact with the surface of third side panel 42 opposite second side panel 34. The front tab 70 and the second and third side panels 34 and 42 are adhesively secured in these relative positions to define the second side wall of the container 72 as shown in FIG. 2. The relationship of the second and third side panels 34 and 42 in the second side wall of container 72 helps to ensure that container 72 will have adequate strength to protect the fragile slices of pie stored therein.

As illustrated most clearly in FIG. 2, the subject container 72 has rear opening members defined by top and bottom rear flaps 50 and 58 and rear tabs 66 and 68. This opening in container 72 enables the slidable insertion of the slice of pie the rear of container 72 by mechanized packing equipment without a substantial likelihood of damaging the pie. The pie also may be easily removed from the subject container 72 with considerable ease and with little likelihood of damaging the pie.

The subject container 72 is closed by first rotating the rear tabs 66 and 68 about rear side edges 20 and 48 respectively, until the rear tabs 66 and 68 are substantially in the plane defined by top and bottom base edges 26 and 32. Bottom rear flap 58 then is rotated upwardly about base edge 32 until it lies in face to face contact with the rear tabs 66 and 68. Finally, the top rear flap 50 is rotated downwardly about base edge 26 until it is in abutting face to face relationship with the bottom rear flap 58. The rear tabs 66 and 68 and the bottom and top rear flaps 58 and 50 are secured in this closed position, as shown most clearly in FIG. 3, by any known means, such as adhesive. Once secured in this closed position, as shown in FIG. 3, the rear of the subject container 72 is supported by both top and bottom rear flaps 50 and 58 thereby contributing to the protection of the delicate crust on the pie stored therein.

Figure 3:
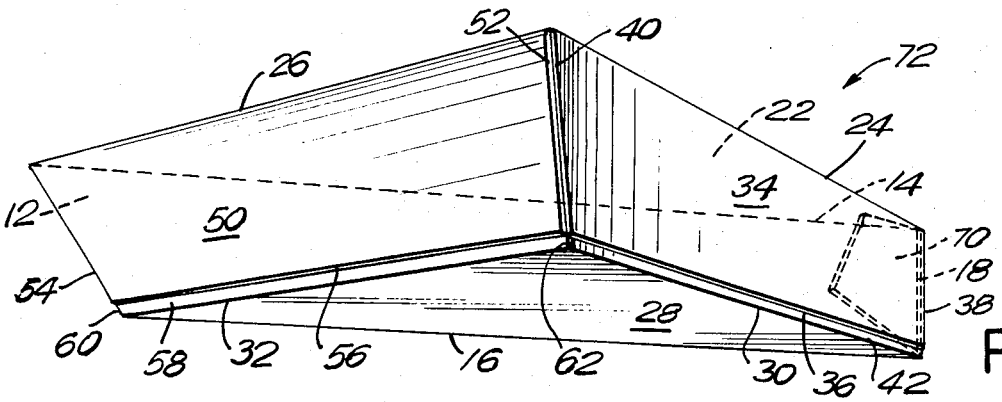
FIG. 3 is a perspective view of the completely erected container formed from the blank shown in FIG. 1.

As is apparent from FIG. 3, the subject container 72 is of virtually the same size and shape as the pie slice inserted therein, thereby prohibiting any significant movement of the pie during shipping and storage. Specifically, the side panels 12, 34, and 42 have a trapezoidal configuration that very closely conforms to the configuration of each side edge of the slice of pie. Additionally, the top and bottom rear flaps 50 and 58, which define the rear edge of the container 72 slope upwardly and away from the bottom panel 20 at an angle that substantially conforms to the angle of the crust extending between the top and bottom surfaces of the slice of pie. These various angular relationships between the panels of the subject container 72, when combined with the side wall constructed from the second and third side panels 34 and 42, and the rear wall formed by the top and bottom rear flaps 50 and 58 provides adequate protection for the delicate slice of pie.

Figure 4:
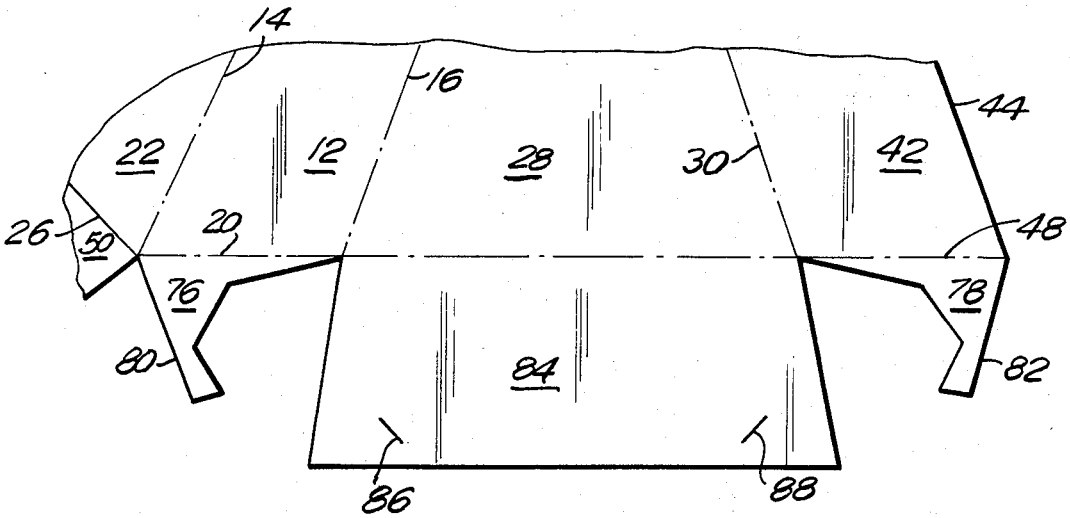
FIG. 4 is a portion of an alternate embodiment of the blank of the subject invention.

FIG. 4 shows a portion of an alternate embodiment for blank 10 of the subject invention. Briefly, on the alternate embodiment of blank 10, shown in FIG. 4, rear locking tabs 76 and 78 are provided in place of the rear tabs 66 and 68 which were part of the embodiment illustrated in FIG. 1. The rear locking tab 76 is hingedly connected to the first side panel 12 along edge 20 thereof as illustrated in FIG. 4. Similarly, the rear locking tab 78 is hingedly connected to the third side panel 42 along edge 48 thereof. The rear locking tabs 76 and 78 are provided with locking hook members 80 and 82.

The bottom rear flap 84, shown in FIG. 4, is hingedly connected to the bottom panel 28 along the base edge 32. Bottom rear flap 84 differs from the bottom rear flap 58 shown in FIG. 1, in that a pair of locking slots 86 and 88 are provided on bottom rear flap 84. Locking slots 86 and 88 are die-cut into bottom rear flap 84 and are located thereon so as to accept the locking hooks 80 and 82 of the rear locking tabs 76 and 78 respectively.

The alternate blank 10 shown in FIG. 4 is erected into its open position as depicted in FIG. 2 in the same manner as explained above. However, the blank 10 shown in FIG. 4 is closed into the position shown in FIG. 3 by engaging the locking hooks 80 and 82 into the slots 86 and 88 on bottom rear flap 84. More particularly, the container erected from the blank 10 shown in FIG. 4 is closed by first rotating bottom rear flap 84 about base edge 32 until bottom rear flap 84 lies in the plane defined by base edges 26 and 32 of the top and bottom panels 22 and 25 respectively. The rear locking tabs 76 and 78 are folded into face to face relationship with bottom rear flap 84 such that locking hooks 80 and 82 are inserted into and engaged by slots 86 and 88. Top rear flap 50 then is rotated about base edge 26 into face to face relationship with first and second rear locking tabs 76 and 78 and bottom rear flap 84. Top rear flap 50 then is secured in this position by any known means, such as adhesive. As explained above, the container erected in this manner assumes a configuration substantially identical to the size and shape of the slice of pie inserted therein, and thus provides protection during shipping and storage.

In summary, there is provided a paperboard container for individual servings of pie and a blank for forming the same. The subject container is substantially wedge shaped and dimensioned to approximately the same size as the slice of pie therein. The container includes substantially parallel top and bottom panels having an isosceles triangular configuration. The top panel is larger than the bottom panel to reflect the frusto-conical shape of the pie. The side wall panels of the subject container are substantially trapezoidal in configuration with the rear side edges of each side panel extending upwardly and away from the bottom panel toward the top panel. Thus, the subject container provides the necessary support for the fragile piece of pie stored therein. The opening of the subject container is disposed at the rear portion thereof. This rear opening configuration makes the subject container particularly well adapted for automated packaging devices, and substantially minimizes the risk of damage to the pie during packaging. The rear opening configuration also facilitates the removal of a piece of pie from the subject container by the consumer further minimizing any damage to the pie prior to its consumption.

While the preferred embodiments of the subject invention have been described and illustrated, it is obvious that various changes and modifications can be made therein without departing from the spirit of the present invention which should be limited only by the scope of the claims.

What is claimed is:

1. A paperboard blank for forming a wedge shaped carton having an openable slanted rear wall, said blank comprising:

a trapezoidal first side panel having parallel top and bottom edges and non-parallel first and second side edges, said first side edge being substantially perpendicular to said top and bottom edges, and said top edge being longer than said bottom edge;

an isosceles triangular top panel having first and second equal side edges and a base edge, said top panel first side edge and said first side panel top edge being hingedly connected and of equal length;

an isosceles triangular bottom panel having first and second equal side edges and a base edge, said bottom panel first side edge and said first side panel bottom edge being hingedly connected and of equal length, the angle between said first and second side edges of said top panel being equal to the angle between the first and second side edges of said bottom panel;

a trapezoidal second side panel having parallel top and bottom edges and non-parallel first and second side edges, said first and second side panels being substantially identical in size and configuration, said second side panel top edge and said top panel second side edge being hingedly connected and of equal length;

a trapezoidal third side panel having parallel top and bottom edges and non-parallel first and second edges, said first and third side panels being of substantially identical size and configuration, said third side panel bottom edge and said bottom panel second side edge being hingedly connected and of equal length;

an isosceles trapezoidal top flap having parallel top and bottom edges and non-parallel side edges, said top flap top edge and said top panel base edge being hingedly connected and of equal length, said top flap bottom edge and said bottom panel base edge being of substantially equal length and said top flap side edges and said first side panel second edge being of substantially equal length; and an isosceles trapezoidal bottom flap having parallel top and bottom edges and non-parallel side edges, said bottom flap and said top flap being of substantially identical size and configuration, said bottom flap bottom edge and said bottom panel base edge being hingedly connected and of substantially equal length, whereby the carton formed from said blank includes a double side wall and a double slanted rear wall for protecting a slice of pie stored therein.

2. A blank as in claim 1 wherein a front tab is foldably connected to said first side panel along the first side edge thereof.

3. A blank as in claim 1 wherein rear tabs are foldably connected respectively to the second edges of said first and third side panels.

4. A blank as in claim 3 wherein said rear tabs are locking tabs, each said locking tab including a locking hook member, and wherein said bottom flap includes a pair of slots dimensioned and located to engage said locking hook members on a carton formed from said blank.

5. A rear-loading wedge-shaped paperboard container for single serving slices of pie, said container comprising:

opposed substantially parallel isosceles triangular top and bottom panels each having a pair of equal side edges and a base edge, said top panel side and base edges being longer than said bottom panel side and base edges, the angle between the top panel side edges being substantially equal to the angle between the bottom panel side edges;

first and second upstanding substantially identical trapezoidal side walls extending between and connecting said top and bottom panel side edges; and an isosceles trapezoidal rear wall extending between and connecting the base edges of said top and bottom panels, said rear wall comprising an isosceles trapezoidal top flap hingedly connected along the entire length of said top panel base edge and an isoceles trapezoidal bottom flap hingedly connected along the entire length of said bottom panel base edge and coextensive in area with said top flap located immediately adjacent said top flap, whereby said top and bottom flaps of said rear wall may be rotated about the top and bottom panel base edges to open the container.

6. A container as in claim 5 wherein said rear wall further includes a pair of rear tabs, one said rear tab being hingedly connected to each said side wall.

7. A container as in claim 6 wherein each said rear tab includes a locking hook member, and wherein said bottom flap includes a pair of slots, said locking hook members being hingedly engaged in said slots.

8. A container as in claim 5 wherein said first trapezoidal side wall is defined by a pair of substantially identical trapezoidal side wall panels disposed in face to face contacting relationship.

9. A container as in claim 8 wherein said first trapezoidal side wall further includes a front tab disposed in face to face contacting relationship with one said trapezoidal side wall panel.

* * * * *